US006651904B2

(12) United States Patent
Roman

(10) Patent No.: US 6,651,904 B2
(45) Date of Patent: Nov. 25, 2003

(54) MULTI-JET WATERING NOZZLE WITH COUNTER-ROTATING ELEMENTS FOR UNDERGROUND POP-UP SPRINKLER

(75) Inventor: Gianfranco Roman, Pasiano (IT)

(73) Assignee: Claber S.p.A. (IT)

( * ) Notice: Subject to any disclaimer, the term of this patent is extended or adjusted under 35 U.S.C. 154(b) by 191 days.

(21) Appl. No.: 10/009,400

(22) PCT Filed: Feb. 20, 2001

(86) PCT No.: PCT/EP01/01840

§ 371 (c)(1),
(2), (4) Date: Oct. 23, 2001

(87) PCT Pub. No.: WO01/62395

PCT Pub. Date: Aug. 30, 2001

(65) Prior Publication Data

US 2003/0071140 A1 Apr. 17, 2003

(30) Foreign Application Priority Data

Feb. 24, 2000 (IT) ..... MI2000A0337

(51) Int. Cl.[7] ..... B05B 15/10

(52) U.S. Cl. ..... 239/204; 239/222.11; 239/230; 239/383

(58) Field of Search ..... 239/200–201, 239/203, 204, 222.11, 222.13, 222.15, 222.17, 230, 233, 240, 244, 251, 383

(56) References Cited

U.S. PATENT DOCUMENTS

| | | | |
|---|---|---|---|
| 5,372,307 | A | 12/1994 | Sesser |
| 5,718,381 | A | 2/1998 | Katzer et al. |
| 6,264,117 | B1 | 7/2001 | Roman |

FOREIGN PATENT DOCUMENTS

| | | |
|---|---|---|
| CH | 187948 | 12/1936 |
| EP | 0339966 | 11/1989 |

*Primary Examiner*—Lisa A. Douglas
(74) *Attorney, Agent, or Firm*—Akerman Senterfitt

(57) ABSTRACT

A watering nozzle (16) for underground pop-up sprinkler (1) comprises a bottom part (17) and a top part (37) comprising a distribution cylinder (40). The bottom part (17) is provided with an annular opening (100) that receives the flow of water coming from the base of the sprinkler (1) and generates a jet in the form of a spray having pre-established angular extension that flows into a distribution cylinder (40) provided with radial slots (41) arranged as an arc of circumference that proceed from its bottom to its side wall so as to subdivide the single spray jet into single jets. The distribution cylinder (40) has on top a fan wheel (70) having a diameter greater than the cylinder and provided with external fins (71) that extend downward. The distribution cylinder (40) rotates under the action of the single jet of water on the walls of said radial slots and by a set of gears (200) the fan wheel (70) is made rotate in opposite sense as compared with the cylinder (40) in such a way that the various jets of water coming out of the slots (41) are deviated in radial direction.

11 Claims, 5 Drawing Sheets

MULTI-JET WATERING NOZZLE WITH COUNTER-ROTATING ELEMENTS FOR UNDERGROUND POP-UP SPRINKLER

The present invention refers to a multi-jet watering nozzle with counter-rotating elements for an underground pop-up sprinkler.

As it is generally known, retracting sprinklers, or pop-up sprinklers, are provided with appropriate nozzles for the output of water. Said nozzle is fastened to the risible part of the sprinkler and is therefore subject to the up and down movement which is characteristic of the sprinkler.

A watering nozzle for pop-up sprinkler is described in the Italian patent application MI99A000710 of Apr. 7, 1999 by the same Applicant and it comprises a main body fastened to the risible part of the sprinkler in order to receive the flow of water coming from the base of the same sprinkler and to deliver it to outside in the form of a single jet with pre-established capacity and angular extension, and a ring nut associated with said main body in order to allow the adjustment of the angle of the jet.

A multi-jet watering nozzle for pop-up sprinkler is also known comprising a bottom part that is suitable to receive the flow of water coming from the base of the sprinkler and to generate a jet in the form of a spray having preestablished angular extension through an annular opening, and a top part that is made up of a distribution cylinder that is rotating about its axis and provided with radial ducts that proceed from its bottom to its side wall in such a way as to divide the water spray coming from the annular opening of the bottom part of the nozzle into single jets arranged radially along said pre-established radial extension.

This latter nozzle has the disadvantage that the rotation of the distribution cylinder determines the formation of single jets that, instead of being exactly radial, have a spiral-like course. This translates into a single radial extension of the jets that is relatively modest as compared with the quantity of water that enters the sprinkler.

In view of the state of the art herein described, scope of the present invention is to present a watering nozzle with single jets for an underground pop-up sprinkler that overcomes the aforementioned inconvenience, increasing the radial extension of the jets with an equal capacity.

According to the present invention, such scope has been attained by means of a watering nozzle for underground pop-up sprinkler, comprising a bottom part fastened to a risible part of the sprinkler and suitable to receive the water flow coming from the base of the sprinkler and to generate through an annular opening a jet in the form of a spray with pre-established angular extension, and a top part that is made of a distribution cylinder provided with radial slots that proceed from its bottom to its side wall so as to divide into single jets the water spray coming from said annular opening, said distribution cylinder being rotatable around its axis due to the action of the water against the walls of said radial slots, characterised in that above said distribution cylinder a fan wheel coaxial to the cylinder but with greater diameter is placed, said fan wheel being cinematically connected with the distribution cylinder so as to rotate in an opposite sense with respect to the cylinder due to the rotation of the latter and being provided with external fins that extend towards the bottom in order to deviate in opposite direction with respect to the one determined by the rotation of the distribution cylinder, and therefore in radial direction, the water jets coming out of said slots of said cylinder.

Owing to the present invention it is possible to realise a multi-jet watering nozzle for an underground pop-up sprinkler that allows to obtain water jets with greater range as compared with the known pop-up sprinklers. This allows to reduce the amount of water required by the sprinklers, as well as to use a lower number of sprinklers to realise a watering system, since each pop-up sprinkler can water an area greater than with the known pop-up sprinklers.

On the other hand, considering the larger range of the water jets, it is possible to realise watering systems in places with shortage of water that use pop-up and distribution tubes with small diameter but that guarantee the same efficiency as traditional watering systems.

The characteristics and the advantages of the present invention will become evident from the following detailed description of an embodiment thereof, that is illustrated as a non-limiting example in the enclosed drawings, in which:

FIG. 4 shoes a perspective bottom view of the same elements in FIG. 3;

FIG. 5 shows in top view various types of insert that are utilisable in the watering nozzle in the previous figures in order to realise a water spray with pre-established angular extension;

FIG. 6 shows corresponding sections according to the line VI—VI of the inserts in FIG. 5;

FIG. 7 shows a section according to the line VII—VII of the pop-up sprinkler in FIG. 1.

Figure 1:
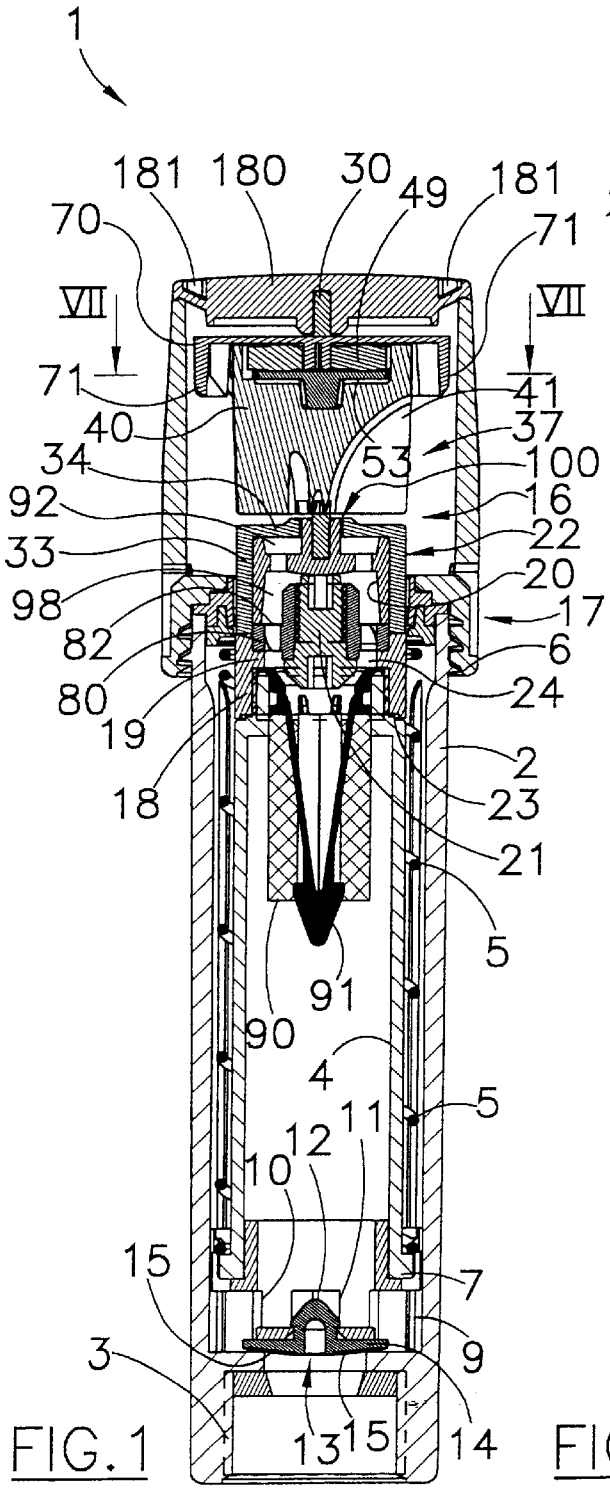
FIG. 1 shows in axial section, in rest position, a pop-up sprinkler that utilises a watering nozzle according to the present invention.
Figure 2:
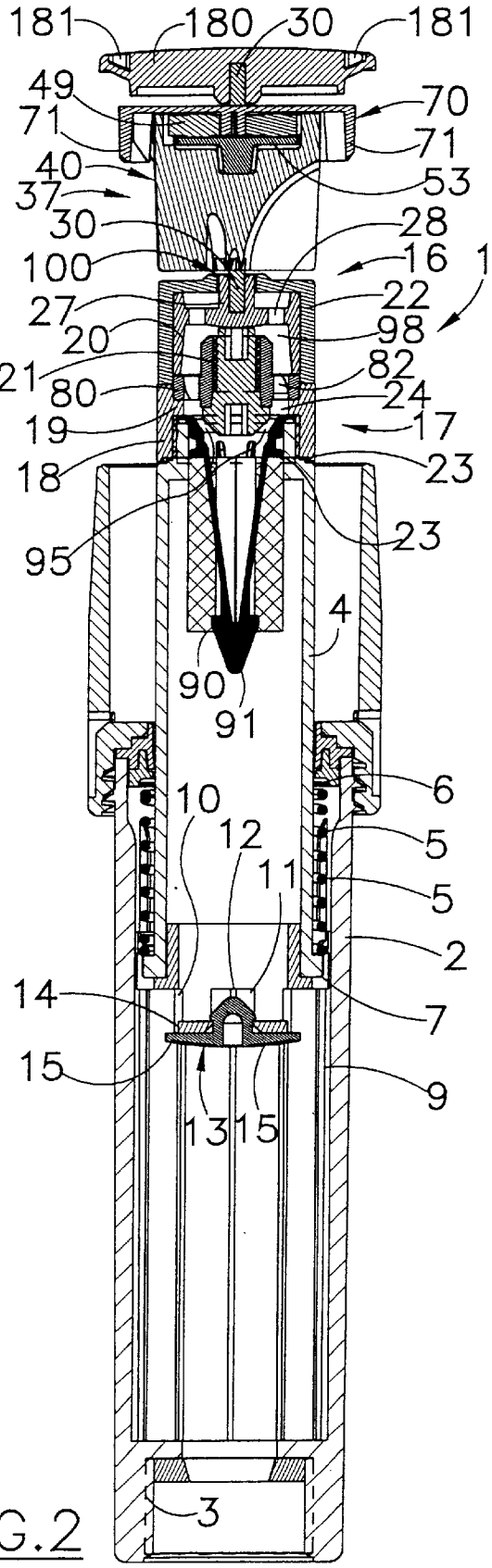
FIG. 2 shows in axial section the pop-up sprinkler in FIG. 1 with the risible part of delivery of the jets in raised position.

In FIGS. 1 and 2 a pop-up sprinkler 1 is shown comprising an external tubular casing 2 that has a bottom mouth 3 that is fastenable to a supplying hose not visible in the figures. Said sprinkler contains inside of it a risible tubular part 4, that it is arranged coaxial to the casing 2 and around which a spring 5 is wound that it reacting between a top ring 6 fastened to the external casing 2 and a bottom ring 7 supported by the risible part 4.

The bottom ring 7 alternates external side projections and recesses that engage with corresponding recesses and projections 9 of the casing 2 so as to guide the vertical movement of the risible part 4. The ring 7 has a bottom part 10 made up of a smaller diameter ring, that has a central hole 11 in which an axial extension 12 of a valve 13 is embedded that is made up of a disc 14 having small thickness, generally made of rubber, provided with small radial slots 15 that, when the valve is closed and the system is at rest, allows the drainage of the water contained in the sprinkler toward the supplying hose underneath.

At the top end of the risible part 4 a watering nozzle 16 is fastened comprising a bottom part 17 and a top part 37. The bottom part is made of an external annular portion 18, an inner annular portion 80, an annular insert 20, an adjustment screw 21 and a covering nozzle or watering cylinder 22.

The annular portion 18 is directly fastened to the risible part 4 of the sprinkler 1 and, for this reason, it is provided with notches 23 that are suitable to co-operate with teeth of the risible part 4 (not shown in the figures) in order to prevent the rotation of the nozzle during the stage of positioning of the sprinkler. The annular portion 18 is provided with an intermediate transversal wall 19 that is passed through by a distribution of holes 24, preferably having round shape, for the flow of the water coming from the sprinkler.

The external annular portion 18 bears an inner annular portion 80 on the top that is provided with an intermediate transversal wall that is passed through by a distribution of holes 82, preferably having rectangular shape, that are positioned in correspondence of the holes 24 for the flow of water.

Figure 3:
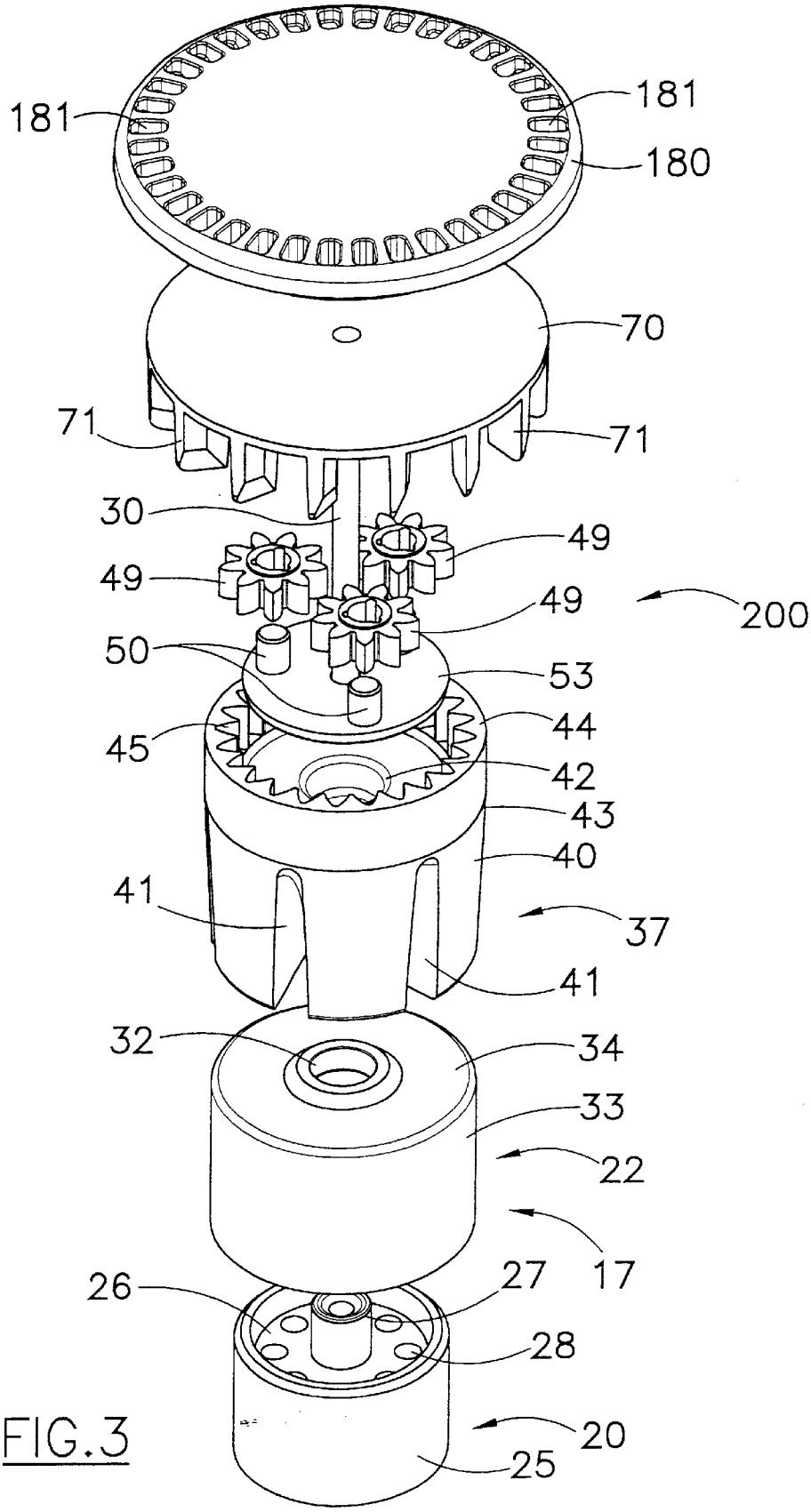
FIG. 3 shows a top perspective view of elements that are part of the watering nozzle in FIG. 1.
Figure 4:
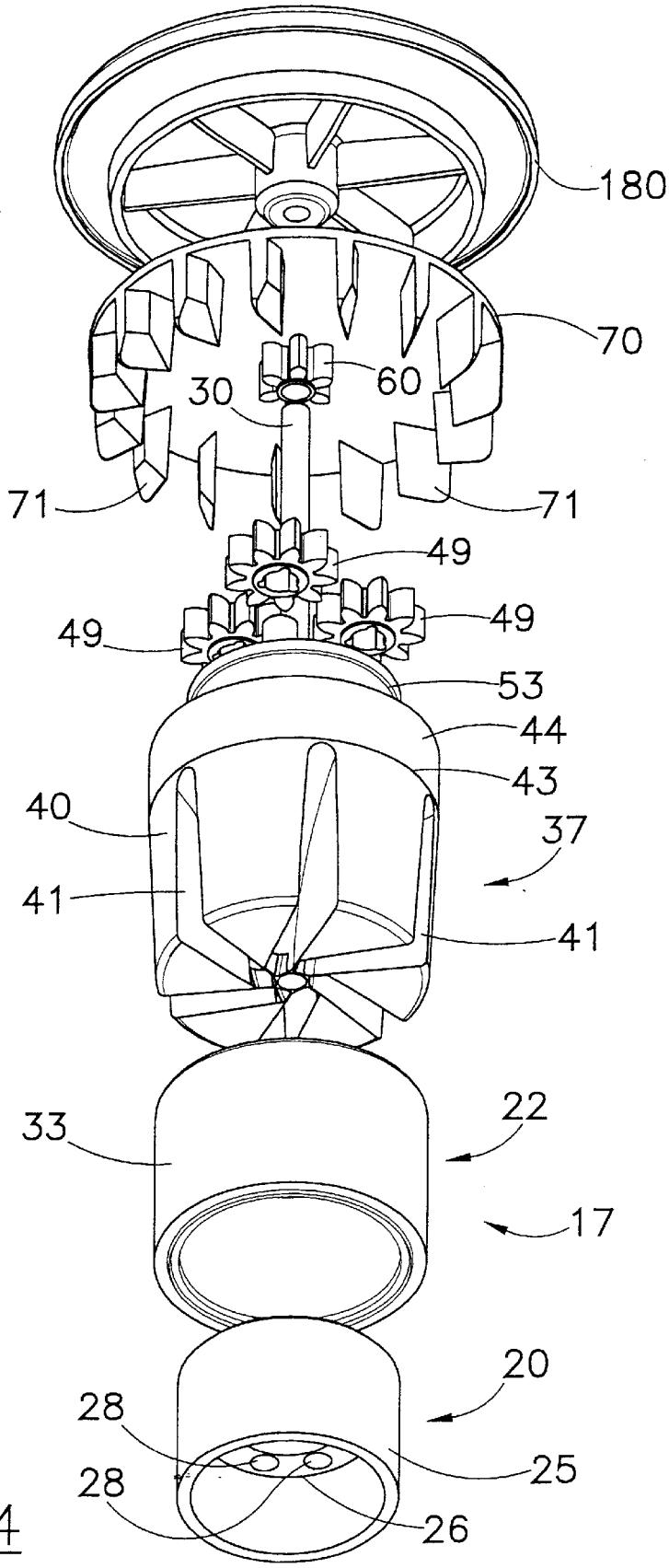
Figure 5:
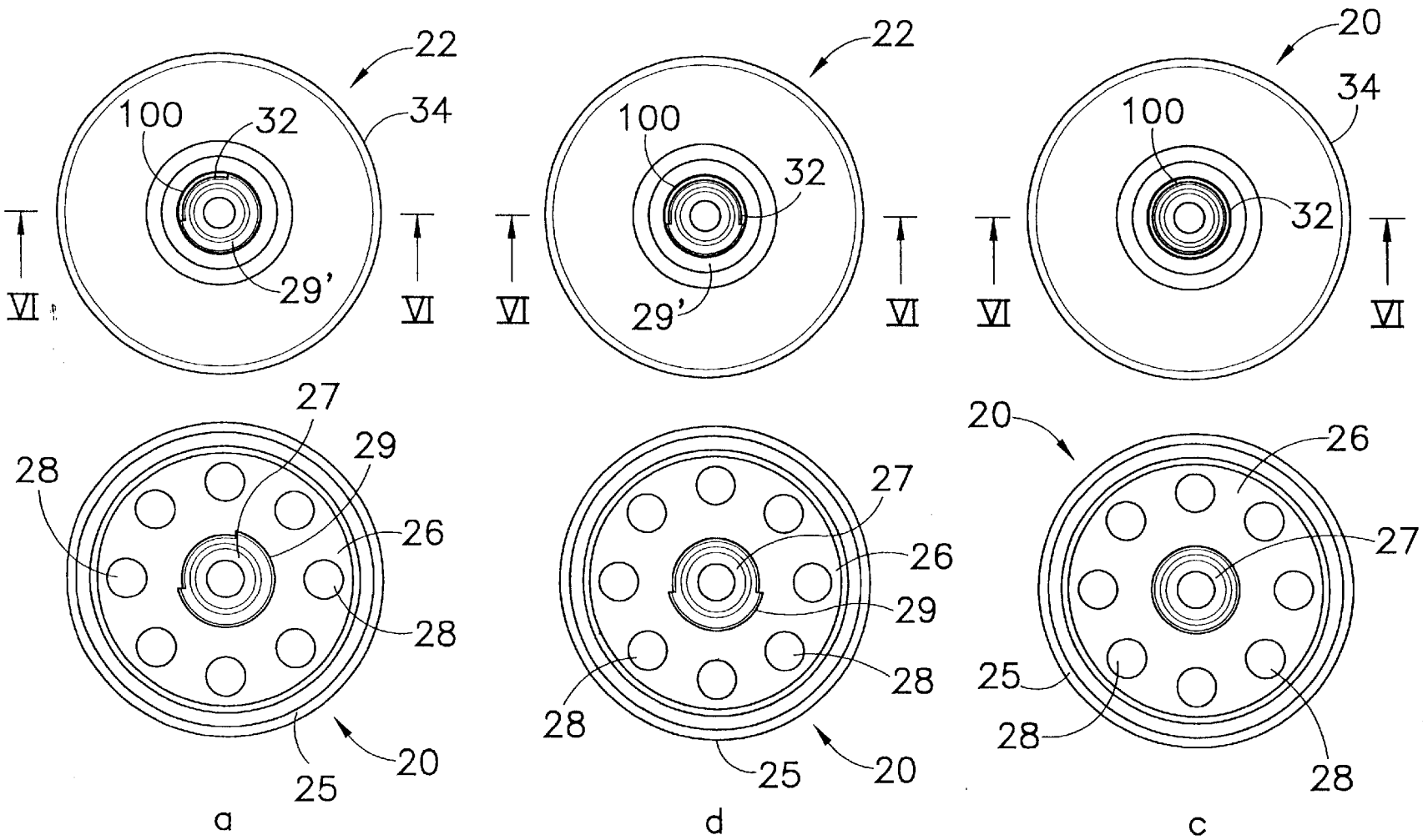

The annular insert 20, shown in greater detail in FIGS. 3, 4 and 5, is made up of a cylindrical side wall 25 that rests on the external round edge of the annular portion 80 and has an internal surface tapered towards the bottom. From said cylindrical wall 25 a transversal wall 26 extends towards the inside, orthogonal to the axial extension of the adjustment screw 21 and above it. Said wall 26 is centrally provided with a pierced axial extension 27, to which a shaft 30 is fixedly mounted, and with a circumferential series of holes 28.

The covering nozzle 22 is made up of a cylindrical body 33 whose bottom edge rests on the annular portion 18 and is provided on the top with a covering orthogonal wall 34 having a central hole 32 that is passed through by the pierced extension 27 of the insert 20 in such way so as to leave an annular opening 100 for the flow of a spray of water coming from the base of the sprinkler.

Figure 6:
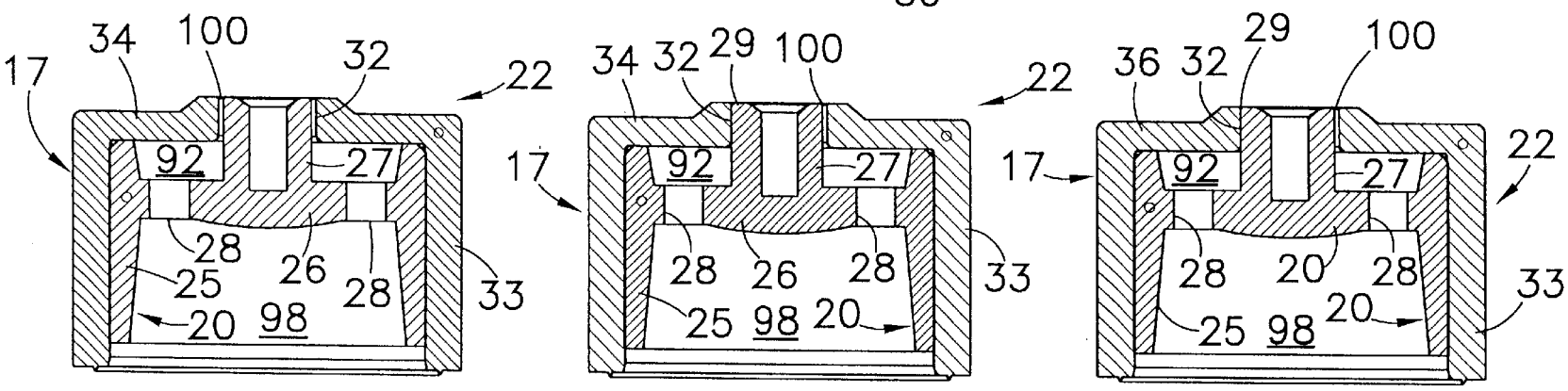

Various types of inserts 20 and covering nozzles 22 are possible, that differ for the fact that said pierced extension 27 of the insert 20 can be provided on its external surface with a projection 29 shaped as an arc of circumference coupled to an analogous septum 29' of the covering nozzle 22, that reduces the opening 100 in order to allow the water spray in output from the covering nozzle 22 to be directed according to a pre-established angle. In fact the projection 29 can have a length of 270° of arc of circumference or 180° of arc of circumference or it can be missing, as seen respectively in the parts a, b and c in FIG. 5 and in the corresponding sections of FIG. 6.

The top part 37 of the watering nozzle 16 comprises a distribution cylinder 40, that is mounted in a freely revolving way on the shaft 30 and is provided with slots 41 having small width that extend radially as an arc of circumference from its bottom to its side wall and with a central axial hole 42 for the passage of the axis 30.

On the edge 43 of the top part of the distribution cylinder 40, an annular portion 44 is fastened that is provided with a toothed internal surface 45. Said toothed surface 45 engages with toothed wheels 49 revolving on respective hinges 50 that are fastened to a disc 53 that is made fixedly mounted to shaft 30 inside of the annular portion 44.

Figure 7:
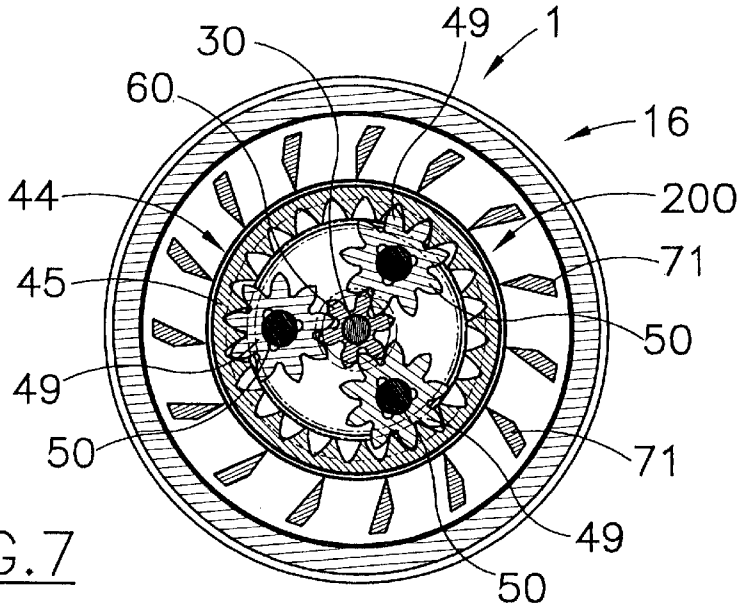

The wheels 49 engage also with a toothed wheel 60 that is centrally fastened to a fan wheel 70 that turningly rests on the annular portion 44 of the distribution cylinder 40 and is centrally pierced, as the small wheel 60, for the free passage of the shaft 30. The toothed surface 45, the toothed wheels 49 and the toothed wheel 60 determine a system of gears 200 that is better visible in FIG. 7.

The fan wheel 70 has a greater diameter than the diameter of the distribution cylinder 40 and it is provided with a circumferential series of external fins 71 on its external edge that surround the annular portion 44 and that extend downward.

The shaft 30 is fastened at its top to a covering 180 arranged above the fan wheel 70 and provided with a circumferential series of notches 181 on its periphery.

The operation of the previously described sprinkler 1 is the following.

Starting from the rest position of the sprinkler 1 in FIG. 1, with the inflow of the water coming from the supplying pipe inside the sprinkler 1, the watering nozzle 16 is thrust upward thus coming out of the casing 2. The water flows through a cylindrical filter 90 connected with the bottom part 17 of the nozzle 16 by means of a V-shaped filter-holder 91, and subsequently through the holes 24 and 82 of the annular portions 18 and 80 it enters inside an area 98 for the containment of the water that is defined between the annular portion 18, the adjustment screw 21 and the insert 20. The quantity of water that enters inside the area 98 can be regulated by screwing or unscrewing the adjustment screw 21 that decreases or increases the passages 95 for the water. The water subsequently passes through the holes 28 of the wall 26 of the insert 20 inside an area 92 defined between the transversal walls 24 and 34 of the insert 20and of the distribution cylinder 22, and then it outflows through the annular opening 100 that is delimited by the hole 32 of the cylinder 22 and by the external surface of the axial extension 27 of the insert 20 thus generating a jet of water shaped as a continuous circumferential spray. Said opening 100 can preferably be reduced to a semi-circumference or a quarter of circumference depending on the presence or absence of the projections 29; in this way it is possible to obtain a water spray with an angular extension of 180° or 90°.

The continuous water spray is subdivided into single jets by the arc-of-circumference slots 41 of the distribution cylinder 40 and the water pressure on their inner walls allows a counter-clockwise rotation of the cylinder 40 around the axis 30. The rotation determines jets distributed on an arc of circle of 360°, at 180°, or 90° according to the type of insert 20 and of distribution cylinder 22.

The rotation of the distribution cylinder 40 through the set of gears 200 determines a corresponding inverse rotation of the fan wheel 70. More precisely the counter-clockwise rotation of the cylinder 40 through the toothed rim 45 determines a counter-clockwise rotation of the wheels 49 that in turn determine a clockwise rotation of the small wheel 60. The fan wheel 70 thus rotates clockwise, allowing the external fins 41 to hit the water jets coming out of the cavities 41 of the distribution cylinder 40 and to deviate them from their natural spiral-wise course toward a radial direction with a consequent increase in their range.

What is claimed is:

1. Watering nozzle for underground pop-up sprinkler, comprising a bottom part (17) fastened to a risible part (4) of the sprinkler (1), suitable to receive the water of flow coming from the base of the sprinkler (1) and to generate a jet in the form of a spray with a pre-established angular extension, and a top part (37) that is made up of a distribution cylinder (40) provided with radial slots (41) that proceed from its bottom to its sidewall so as to divide the water spray coming from said annular opening (100) into single jets, said distribution cylinder (40) being rotatable about its own axis due to the action of the water against the walls of said its radial slots (41), characterised in that at the top of said distribution cylinder (40) a fan wheel (70) coaxial to the cylinder (40) but with greater diameter is placed, said fan wheel (70) being cinematically connected with the distribution cylinder (40) so as to rotate in opposite sense as regards the cylinder (40) due to the effect of the rotation of the latter and being provided with fins (71) that extend downward in order to deviate in opposite sense with respect the one determined by the rotation of distribution cylinder (40), and therefore in radial direction, the water jets coming out of said slots (41) of said cylinder (40).

2. Watering nozzle according to claim 1, characterised in that said annular opening (100) has an angular extension of 360°.

3. Watering nozzle according to claim 1, characterised in that said annular opening (100) is reduced circumferentially so as to obtain a water jet with shape of spray with an angular extension substantially of 90°.

4. Watering nozzle according to claim 1, characterised in that said annular opening (100) is reduced circumferentially so as to obtain a water jet with shape of spray with a angular extension substantially of 180°.

5. Watering nozzle according to claim 1, characterised in that said bottom part (17) comprises an annular insert (20) provided with a transversal wall (26) provided with a distribution of holes (28) for the flow of the water inside an area (92) for the top containment defined between said insert (20) and a cylindrical covering nozzle (22) that it encloses said annular file (20), being said insert (20) provided with a central extension (27) inserted into a central hole (32) of said covering nozzle (22) so as to define said annular opening (100).

6. Watering nozzle according to claim 5, characterised in that said angular opening (100) is reduced circumferentially by the presence of a radial projection (29) shaped as an arc of circumference of the external lateral surface of said extension (27) of said insert (20).

7. Watering nozzle according to claim 6, characterised in that said projection (29) has an angular extension substantially equal to 180°.

8. Watering nozzle according to claim 6, characterised in that said projection (29) has an angular extension substantially equal to 270°.

9. Watering nozzle according to claim 5, characterised in that said bottom part (17) is made up of a bottom annular portion (18) that is fastened to the top end of the risible part (2) of the sprinkler (1) and communicating with the output mouth of the same, and of a top annular portion (80) defining with said insert (20) a bottom containment area (98) that communicates with said top containment chamber (92) through said distribution of holes (28) of the annular insert (20) and with the output mouth of the risible part (4) of the sprinkler (1) through additional distributions of holes (24, 82) of said bottom and top annular portions (18, 80).

10. Watering nozzle according to claim 9, characterised in that it comprises an adjustment screw (21) held by said top annular portion (80) in order to regulate the flow of the water output by said risible part (4) of the sprinkler (1).

11. Watering nozzle according to claim 1, characterised in that said fan wheel (70) is kinematically connected with said distribution cylinder (40) by means of a set of gears (200) that comprises a toothed rim (45) that is fastened at the top to said distribution cylinder (40), toothed wheels (49) that are freely revolving over said distribution cylinder (40) that engage with said toothed rim (45) and a toothed wheel (60) that is fixedly mounted to said fan wheel (70) that engages with said toothed wheels (49).

* * * * *